US008727483B2

(12) United States Patent
Sugiura et al.

(10) Patent No.: US 8,727,483 B2
(45) Date of Patent: May 20, 2014

(54) LIQUID EJECTION APPARATUS

(71) Applicants: Keita Sugiura, Nagoya (JP); Shingo Hattori, Nagoya (JP)

(72) Inventors: Keita Sugiura, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/630,173

(22) Filed: Sep. 28, 2012

(65) Prior Publication Data

US 2013/0120493 A1 May 16, 2013

(30) Foreign Application Priority Data

Nov. 10, 2011 (JP) ..... 2011-246525

(51) Int. Cl.
*B41J 2/165* (2006.01)

(52) U.S. Cl.
USPC ..... 347/29

(58) Field of Classification Search
None
See application file for complete search history.

(56) References Cited

U.S. PATENT DOCUMENTS

2011/0242204 A1* 10/2011 Shinoda ..... 347/29

FOREIGN PATENT DOCUMENTS

| | | | |
|---|---|---|---|
| JP | 07-179004 | A | 7/1995 |
| JP | 09-085959 | A | 3/1997 |
| JP | 2006-088608 | A | 4/2006 |
| JP | 2010-012650 | A | 1/2010 |

* cited by examiner

*Primary Examiner* — Alejandro Valencia
(74) *Attorney, Agent, or Firm* — Banner & Witcoff, Ltd.

(57) ABSTRACT

A liquid ejection apparatus includes a cap, an opposing member opposing an ejection surface of a liquid ejection head which is elongated in one direction, and a cap moving mechanism arranged to move the cap. The cap includes a lip component, a diaphragm, and a holder having a lower linear expansion coefficient and higher rigidity than the lip component. On the elongated portions of the lip component, either first hooks or first receiving portions hooked on the first hooks are formed, whereas the other first hooks or first receiving portions are formed at parts of the holder which parts oppose the elongated portions. The lip component is connected with the holder such that the first hooks hook the first receiving portions in a direction orthogonal to the ejection surface. In the one direction, gaps are formed between the first hooks and the first receiving portions.

17 Claims, 10 Drawing Sheets

MAIN SCANNING DIRECTION

SUB SCANNING DIRECTION

LIQUID EJECTION APPARATUS

CROSS REFERENCE TO RELATED APPLICATION

The present application claims priority from Japanese Patent Application No. 2011-246525, which was filed on Nov. 10, 2011, the disclosure of which is herein incorporated by reference in its entirety.

BACKGROUND OF THE INVENTION

1. Field of the Invention

The present invention relates to a liquid ejection apparatus arranged to eject liquid through ejection openings.

2. Description of the Related Art

A known inkjet recording apparatus caps the nozzle surface of a record head by means of a cap and a conveyance belt, by causing the cap formed around the record head to closely contact the conveyance belt. In such an inkjet recording apparatus, the cap may include an annular side plate surrounding the record head and a flexible sheet having an outer circumferential edge fixed to the upper end of the side plate and an inner circumferential edge fixed to the outer side face of the record head.

SUMMARY OF THE INVENTION

In the inkjet recording apparatus above, the side plate constituting the cap may be composed of an upper portion which is made of metal, hard synthetic resin, or the like and a lower portion which is made of an elastic material such as rubber and fixed to the upper portion. When the materials of the side plate are different in this manner between the upper portion and the lower portion, the linear expansion coefficient is also different between the upper portion and the lower portion. An elastic material such as rubber, which has a higher linear expansion coefficient than resin, extends more than the upper portion along the circumferential direction, when the ambient temperature is increased, for example. In this connection, because the upper portion and the lower portion are fixed to each other, the lower portion is curved. In particular, when the cap is elongated in one direction, the lower portion may be corrugated or may be warped away from the record head. When the ambient temperature is decreased, the deformation in the direction opposite to the above occurs. As the lower portion is curved in this way, a gap is formed between the lower portion and the conveyance belt at the time of the capping, with the result that no closed space is formed. This gives rise to the problem that ink around the nozzles is dried out.

An object of the present invention is to provide a liquid ejection apparatus in which an ejection space opposing an ejection opening is surely sealed.

A liquid ejection apparatus of the present invention includes: a liquid ejection head that has an ejection surface having a plurality of ejection openings and is elongated in one direction; and a capping unit including a cap having an annular lip component and a diaphragm, the annular lip component being made of an elastic material and surrounding the liquid ejection head, the diaphragm being made of an elastic material and being formed between the lip component and the liquid ejection head, an opposing member opposing the ejection surface over an ejection space that opposes the ejection surface, and a cap moving mechanism arranged to move the cap between an abutting position where the lip component abuts to the opposing member and a separated position where the lip component is separated from the opposing member, the cap further having a holder which surrounds the liquid ejection head, has a smaller linear expansion coefficient than the lip component, and has higher rigidity than the lip component, at elongated portions of the lip component, which extend in the one direction, either first hooks or first receiving portions hooked on the first hooks being formed along the one direction, at parts of the holder which parts oppose the elongated portions, the first hooks or the first receiving portions being formed to be paired with the first hooks or the first receiving portions formed at the elongated portions, the lip component and the holder being connected with each other such that the first hooks hook the first receiving portions in the direction orthogonal to the ejection surface, and gaps being formed between the first hooks and the first receiving portions in the one direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
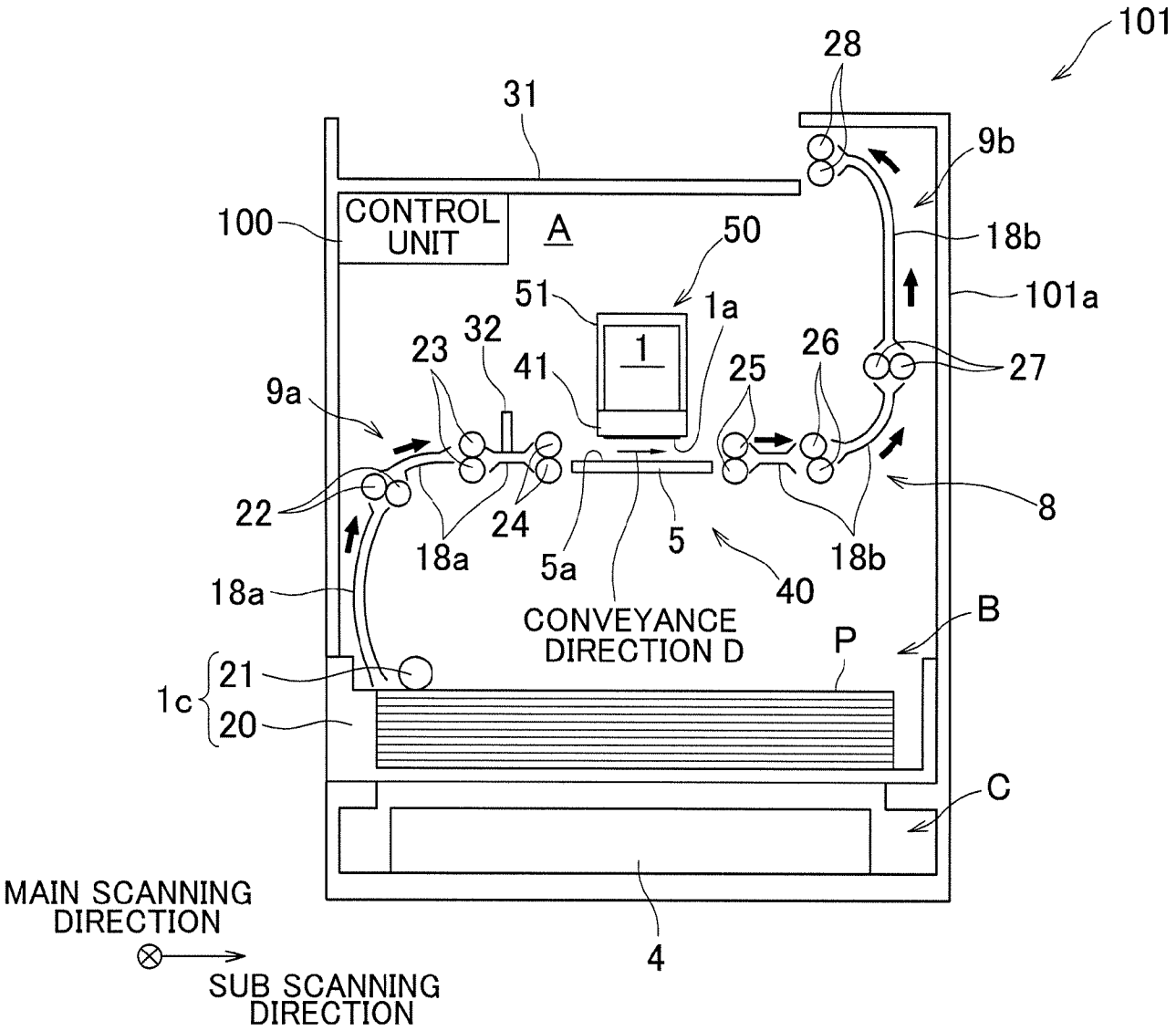
FIG. 1 is a schematic profile showing the internal structure of an inkjet printer as an embodiment of a liquid ejection apparatus of the present invention.

To begin with, with reference to FIG. 1, the overall structure of an inkjet printer 101 as an embodiment of a liquid ejection apparatus of the present invention will be described.

The printer 101 has a rectangular parallelepiped chassis 101*a*. Above the top plate of the chassis 101*a* is provided a sheet discharge section 31. The internal space of the chassis 101*a* is divided into spaces A, B, and C from top to bottom. In the spaces A and B is formed a sheet conveyance path connecting a sheet feeding section 1*c* with the sheet discharge section 31. In the space A, image formation on a sheet P and conveyance of the sheet P to the sheet discharge section 31 are carried out. In the space B, the sheet P is supplied to the conveying path. From the space C, ink is supplied to an inkjet head (liquid ejection head) 1 in the space A.

In the space A are provided components such as the inkjet head 1 (hereinafter, head 1) ejecting black ink, a sheet sensor 32, a conveyance mechanism 8, a capping mechanism 40 as a capping unit, and a control unit 100.

The head 1 is substantially rectangular parallelepiped and is elongated along the main scanning direction. The head 1 is supported by a chassis 101*a* via an unillustrated head holder. The head holder supports the head 1 so that a predetermined gap suitable for recording is formed between the lower surface of the head 1 and a platen 5. On the lower surface (ejection surface 1*a*) of the head 1, a plurality of ejection openings 108 (see FIG. 6) are formed for ejecting ink therethrough.

The sheet sensor 32 detects the leading end of the conveyed sheet P. A detection signal thereof is output to the control unit 100. In the control unit 100, discharge timings for image formation are determined based on the detection signal.

The conveyance mechanism 8 includes two guide units 9*a* and 9*b* guiding the sheet P and the platen 5 which is an opposing member. The two guide units 9*a* and 9*b* are provided to sandwich the platen 5. The guide unit 9*a* on the upstream in the conveyance direction has three guides 18*a* and three feed roller pairs 22 to 24, and connects the sheet feeding section 1*c* with the platen 5. The guide unit 9*a* conveys the sheet P for image formation toward the platen 5. The guide unit 9*b* on the downstream in the conveyance direction has three guides 18*b* and four feed roller pairs 25 to 28, and connects the platen 5 with the sheet discharge section 31. The sheet P after the image formation thereon is conveyed toward the sheet discharge section 31.

In the space B is provided the sheet feeding section 1*c*. The sheet feeding section 1*c* has a sheet feeding tray 20 and a pickup roller 21. Among these components, the sheet feeding tray 20 is arranged to be detachable to the chassis 101*a*. The sheet feeding tray 20 is an open-top box able to store a plurality of sheets P. The pickup roller 21 sends out the topmost one of the sheets P in the sheet feeding tray 20.

It is noted that the sub-scanning direction is a direction in parallel to the conveyance direction D (indicated by the arrow D in FIG. 1) in which the sheet P is conveyed by the feed roller pairs 23 to 25, whereas the main scanning direction is in parallel to the horizontal plane and orthogonal to the sub-scanning direction.

In the space C, a cartridge 4 storing black ink is detachably attached to the chassis 101*a*. The cartridge 4 is connected to the head 1 via an unillustrated tube to supply ink to the head 1.

Now, the control unit 100 will be described. The control unit 100 controls each component of the printer so as to control the overall operations of the printer 101. The control unit 100 controls an image formation operation based on a recording instruction (e.g., image data) input from an external apparatus (such as a PC connected to the printer 101). More specifically, based on the recording instruction, the control unit 100 drives the sheet feeding section 1*c* and the guide units 9 and 9*b* (conveyance mechanism 8). The sheet P sent out from the sheet feeding tray 20 is guided by the upstream guide unit 9*a* and supplied to the platen 5. When the sheet P is passing through the position immediately below the head 1 in the sub-scanning direction (conveyance direction D), ink is ejected from the ejection surface 1*a* under the control of the control unit 100, with the result that a desired image is formed on the sheet P. The sheet P on which the image has been formed is guided by the downstream guide unit 9*b* and is discharged from an upper part of the chassis 101*a* to the sheet discharge section 31.

Figure 3:
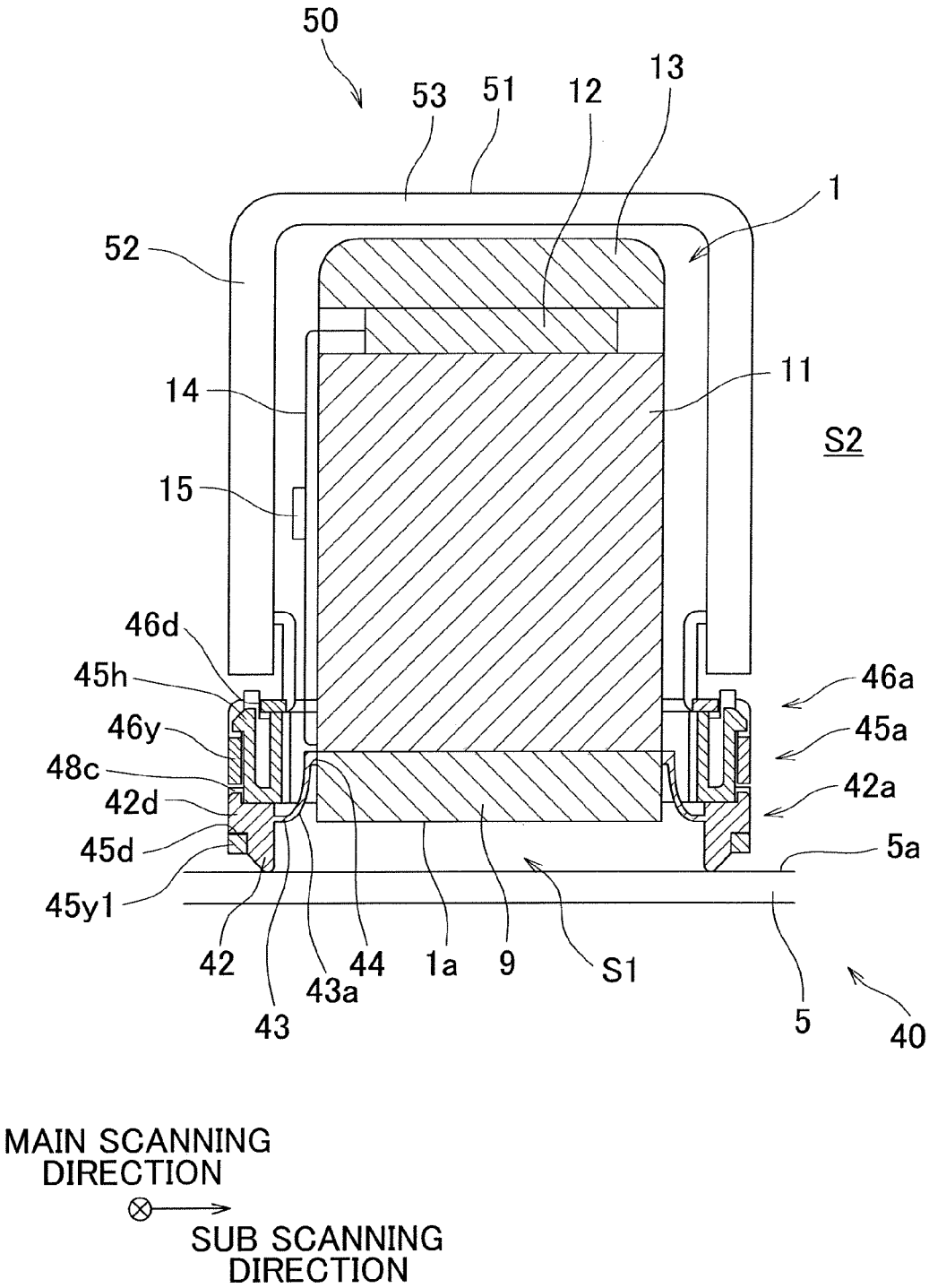
FIG. 3 is a cross section taken along the III-III line in FIG. 2, showing the capped state.

In addition to the above, the control unit 100 controls the capping operation of the head 1. As the capping operation is carried out, as shown in FIG. 3, a lip component 42 of the capping mechanism 40 separates an ejection space (space opposing the ejection surface 1*a*) S1 from the external space S2. This restrains the ink in the ejection opening 108 from becoming dried. It is noted that the capping operation is performed when, for example, the printer 1 is stopped or on standby.

Figure 4:
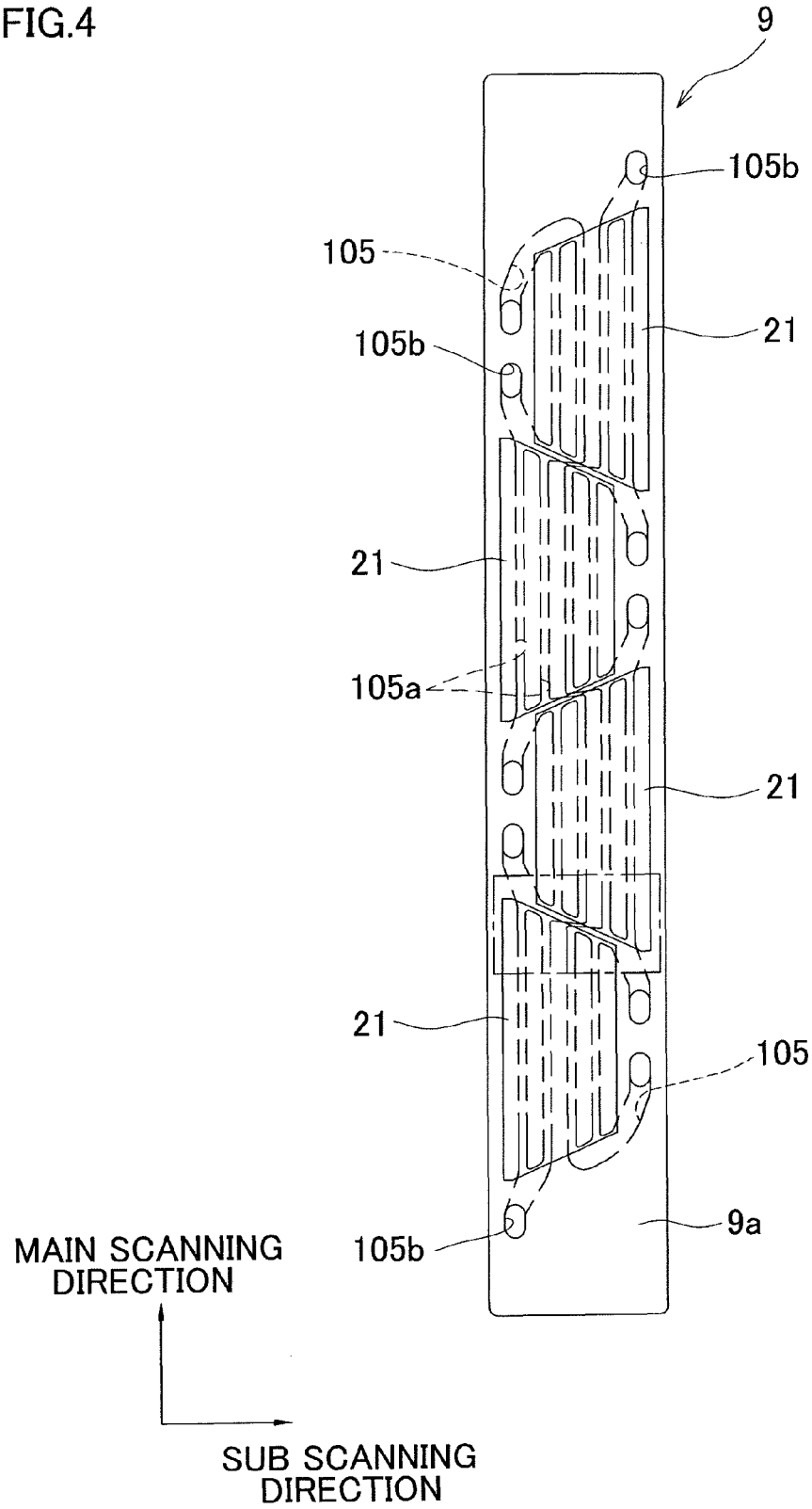
FIG. 4 is a plan view of the head main body of the head in the printer of FIG. 1.
Figure 5:
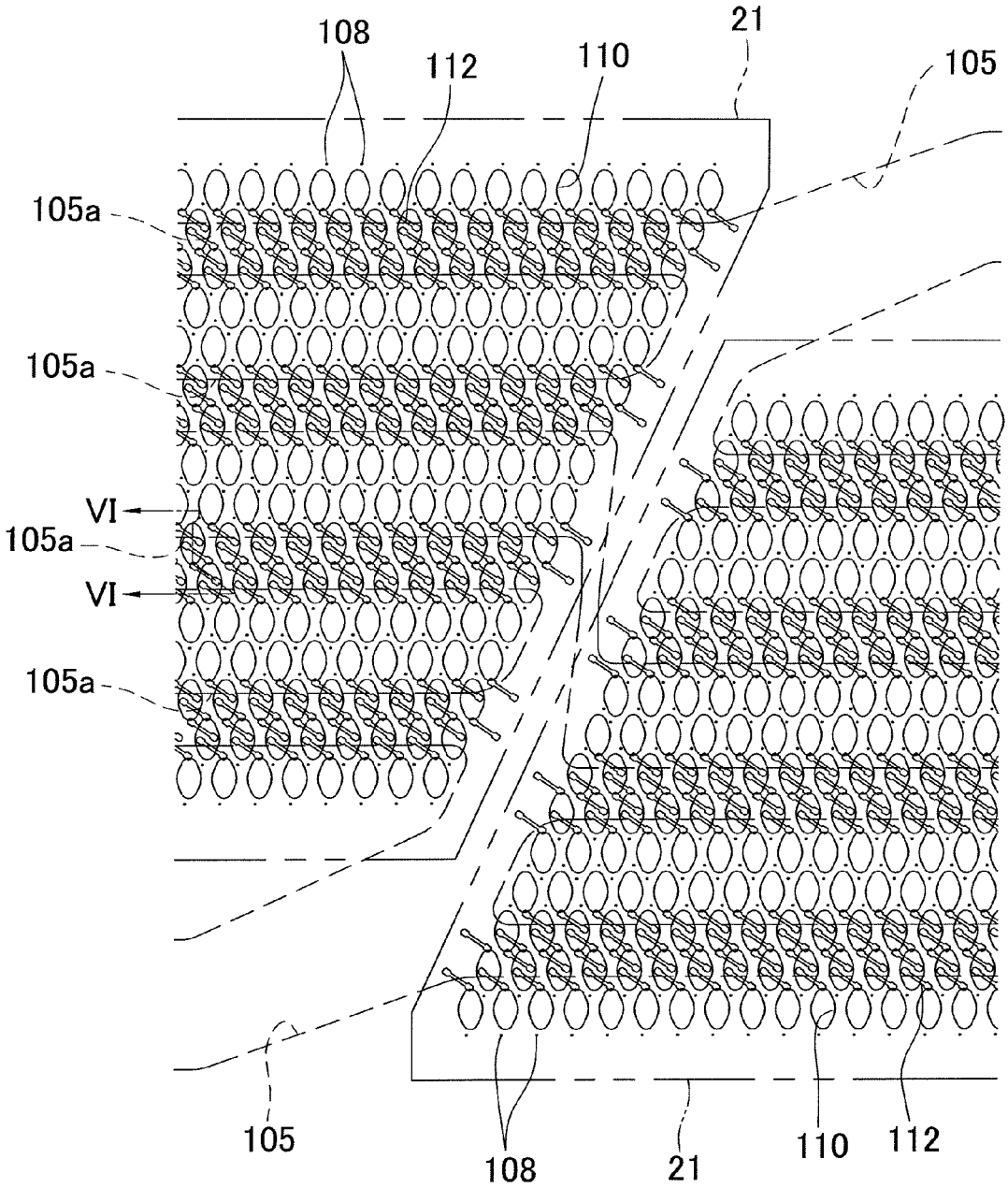
FIG. 5 is an enlarged view of the region enclosed by the dashed line in FIG. 4.

Now, referring to FIG. 2 to FIG. 6, the structure of the head 1 will be described. In FIG. 5, pressure chambers 110 and apertures 112 are depicted by full lines even if they are below the actuator unit 21.

The head 1 is a laminated body formed by laminating a passage unit 9, an actuator unit 21, a reservoir unit 11, a circuit board 12, and a head cover 13 in this order from bottom to top. The reservoir unit 11 as an upstream passage forming component has an upstream ink passage including a reservoir (both of which are not illustrated), and ink is supplied to the reservoir unit 11 from the cartridge 4. The reservoir temporarily stores the ink. Above the reservoir unit 11, as shown in FIG. 3, the head cover 13 is deposited to cover the circuit board 12.

Figure 6:
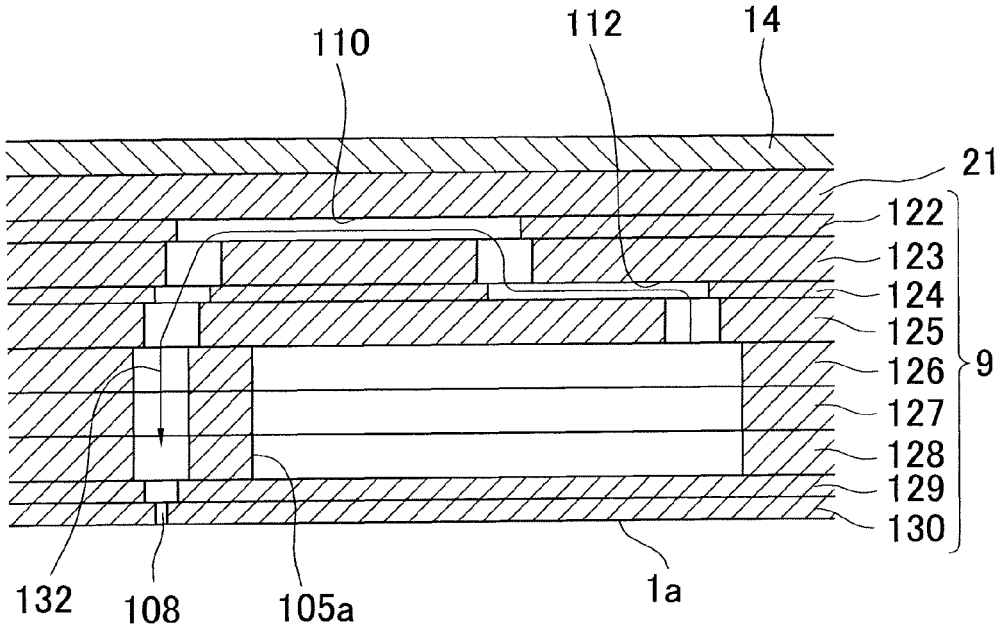
FIG. 6 is a partial cross section taken along the VI-VI line in FIG. 5.

The passage unit 9 as a downstream passage forming component is, as shown in FIG. 6, a laminated body formed by laminating nine rectangular metal plates 122 to 130. The passage unit 9 has a downstream ink passage. The downstream ink passage is, as shown in FIG. 4, connected to the upstream ink passage of the reservoir unit 11 at an opening 105*b* of the upper surface 9*a*. Furthermore, the downstream ink passage is, as shown in FIG. 4 to FIG. 6, constituted by a manifold passage 105 having the opening 105*b* at one end, a sub-manifold passage 105*a* branching from the manifold passage 105, and a plurality of individual ink flow passages 132 connected to the sub-manifold passage 105*a*.

Each individual ink flow passage 132 includes an aperture 112 that functions as an aperture for adjusting flow resistance, and connects the outlet of the sub-manifold passage 105*a* with the ejection opening 108 via the pressure chamber 110. On the upper surface 9*a* of the passage unit 9, a plurality of pressure chambers 110 are provided in a matrix manner. On the other hand, on the ejection surface 1*a* which is the lower surface of the passage unit 9, a plurality of ejection openings 108 are formed in a matrix manner to correspond to the respective pressure chambers 110.

The actuator units 21 are sandwiched between the reservoir unit 11 and the passage unit 9 and are arranged in a staggered manner along the main scanning direction (see FIG. 4). The actuator units 21 are fixed to the upper surface 9*a* of the passage unit 9 to seal the openings of the pressure chambers 110. Each actuator unit 21 is a laminated body formed by laminating a topmost layer, which is a piezoelectric layer polarized in the thickness direction, on a diaphragm. The diaphragm is also a piezoelectric layer made of the same material as the topmost layer. The diaphragm does not actively deform because no voltage is applied thereto. The topmost layer is sandwiched between one of individual electrodes formed on the upper surface and a common electrode formed on the lower surface. As the region sandwiched between one individual electrode of the actuator unit 21 and the common electrode deforms, a region constituted by the sandwiched region and the corresponding region of the diaphragm conduct unimorph deformation. This region conducting unimorph deformation (i.e., the region sandwiched between the individual electrode and the pressure chamber) functions as an individual actuator, and is selectively driven by a drive signal.

The actuator unit 21 is electrically connected to one end of a FPC 14 as shown in FIG. 3 and FIG. 6. The other end of the FPC 14 is electrically connected to the circuit board 12. At the midway portion of the FPC 14, a driver IC 15 is mounted. Under the control of the control unit 100, the FPC 14 transmits various signals (control signal, image signal, etc.) relayed and adjusted by the circuit board 12 to the driver IC 15, and transmits a drive signal generated by the driver IC 15 to a corresponding individual actuator.

Figure 2:
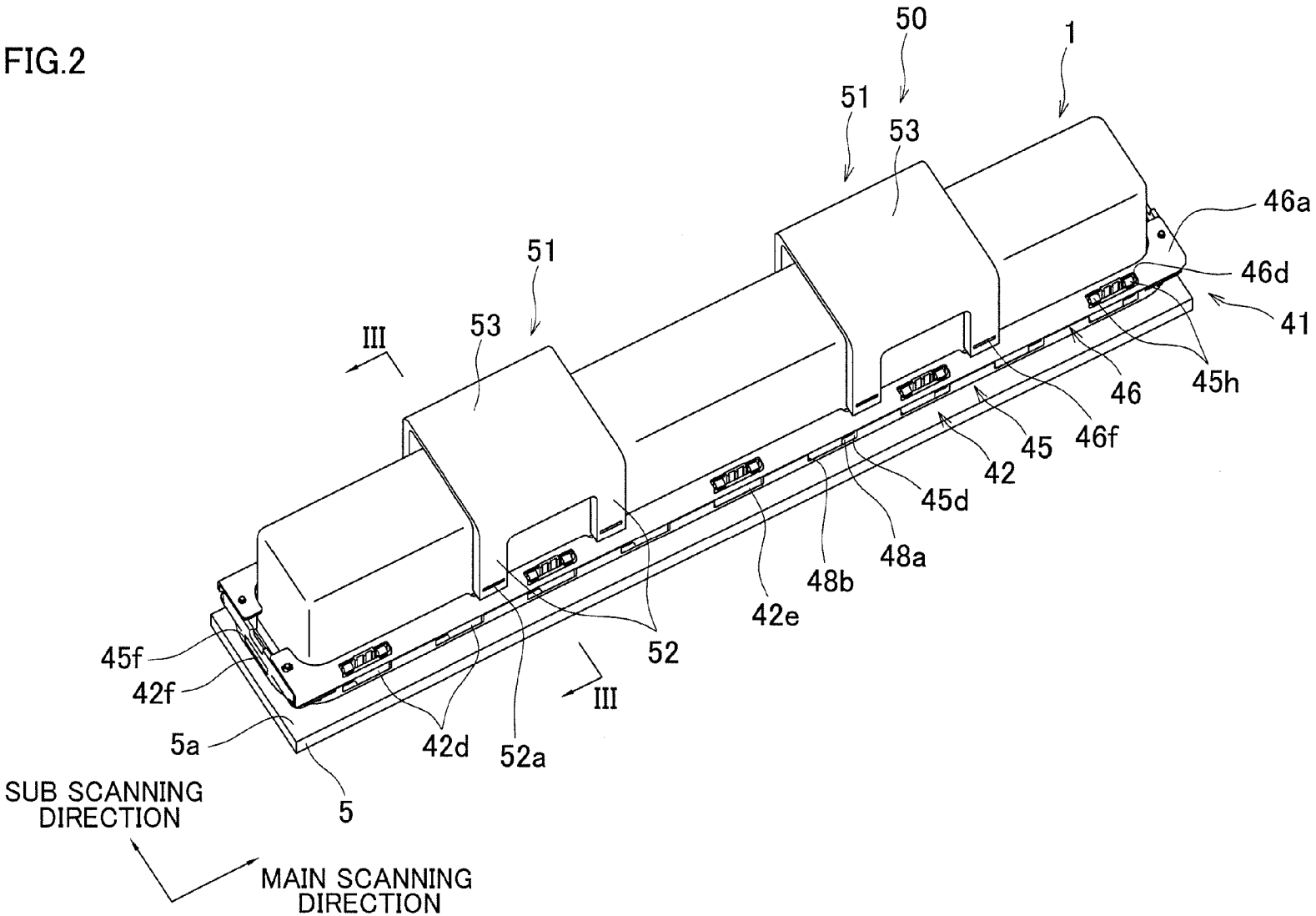
FIG. 2 is an oblique perspective of a head mechanism and a capping mechanism in the printer of FIG. 1.
Figure 8:
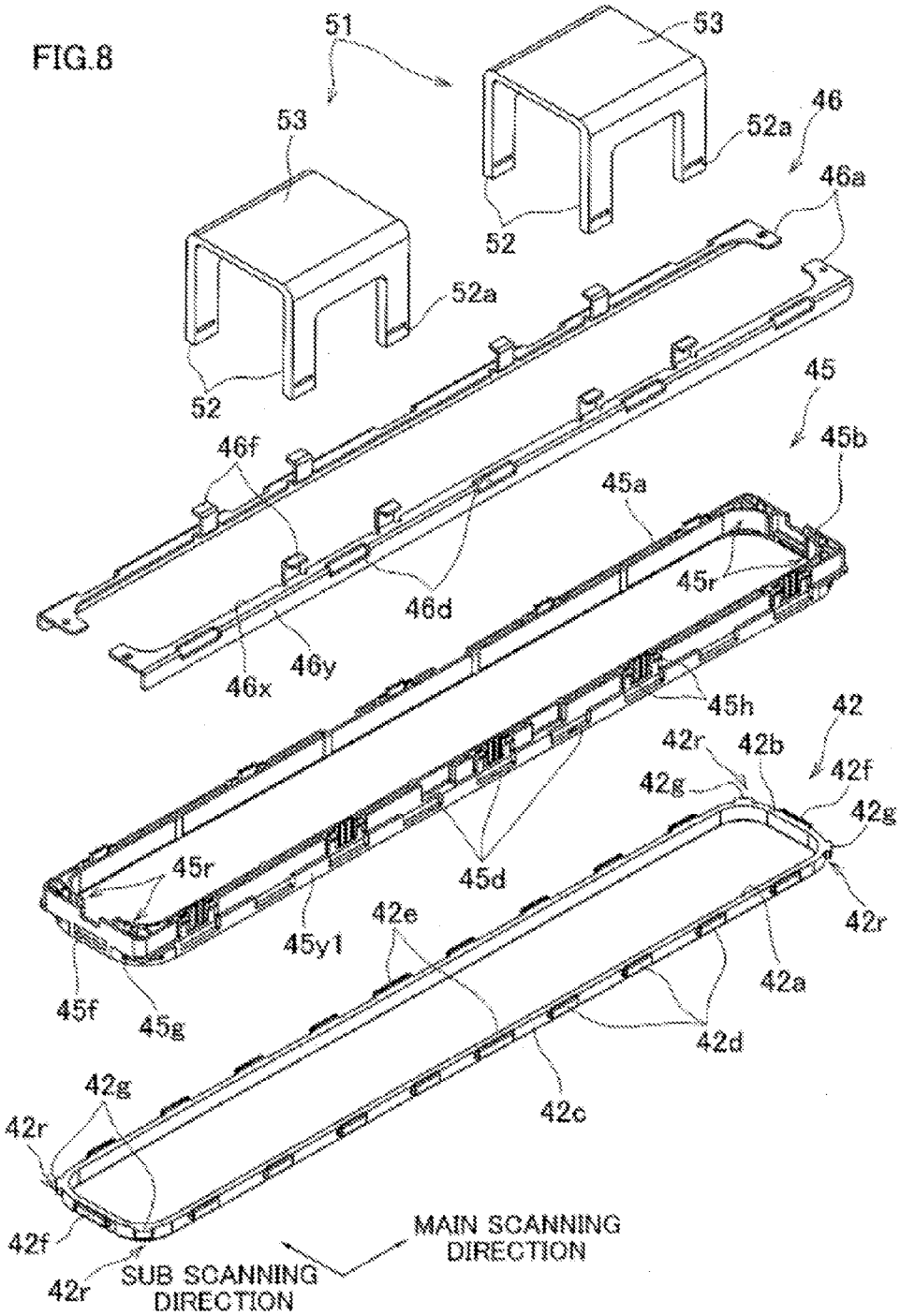
FIG. 8 is a partial exploded perspective view of the capping mechanism.

Now, the structure of the capping mechanism 40 will be described. As shown in FIG. 2 and FIG. 3, the capping mechanism 40 includes a cap 41, a cap elevation mechanism 50, and a platen 5. The cap 41 includes, as shown in FIG. 8, a lip component 42, a holder 45, and a frame 46. The lip component 42 is, as shown in FIG. 3, formed to be integrated with a diaphragm 43 and an attaching portion 44. The lip component 42, the diaphragm 43, and the attaching portion 44 are made of an elastic material such as rubber (e.g., butyl rubber).

The lip component 42 is formed to have an annular shape and to surround the passage unit 9. Furthermore, as shown in FIG. 3, the lip component 42 is tapered in cross section to be narrowed downward. The attaching portion 44 is also formed to have an annular shape. The attaching portion 44 is entirely fixed along the upper end of the side face of the passage unit 9.

The diaphragm 43 is formed to have an annular shape and is stretched between the lip component 42 and the passage unit 9. More specifically, the diaphragm 43 is a flexible thin-film member, and its outer circumferential edge is connected to the inner circumferential surface of the lip component 42 whereas its inner circumferential edge is connected to the lower surface of the attaching portion 44. As such, the gap between the lip component 42 and the passage unit 9 is closed.

The lip component 42 is at the farthest from the attaching portion 44 when it is at an abutting position (shown in FIG. 3) where the lip component 42 abuts to the upper surface 5*a* of the platen 5. At this position, the linear distance between the outer circumferential edge and the inner circumferential edge of the diaphragm 43 is shorter than the length between these edges. In this way, the diaphragm 43 is elastically deformed and a curved portion 43*a* is formed between the lip component 42 and the passage unit 9 as shown in FIG. 3. In the present embodiment, the diaphragm 43 has the curved portion 43*a* irrespective of the position of the lip component 42 with respect to the passage unit 9. Because an outward force away from the passage unit 9 is exerted to the curved portion 43*a* on account of its elastic returning force, an outward biasing force is always exerted to the lip component 42. In other words, a simple capping mechanism 40 is constructed because the lip component 42 certainly abuts to the upper surface 5*a* of the platen 5 as the outward bending of the lip component 42 is restrained.

As shown in FIG. 8, the lip component 42 has a pair of elongated portions 42*a* extending along the main scanning direction and a pair of shortened portions 42*b* provided between the ends of the elongated portions 42*a*. The side peripheral surfaces 42*c* of the elongated portions 42*a* and the shortened portions 42*b* are provided with a plurality of hooks 42*d* (first hook), 42*e* (first hook), 42*f*, and 42*g* (second hook) along the circumferential direction. At the central portions of the elongated portions 42*a* in the main scanning direction are provided hooks 42*e*, and each hook 42*e* is sandwiched between two groups of hooks 42*d* each including four hooks 42*d*. Each shortened portion 42*b* has a single hook 42*f* at its central portion in the sub-scanning direction. At each corner portion 42*r* where the elongated portion 42*a* is connected with the shortened portion 42*b* is provided a single hook 42*g*.

Each of the hooks 42*d*, 42*e*, and 42*f* is constituted by, as shown in FIG. 3 and FIG. 8, a base protruding outward from the profile 42*c*, and a leading end portion extending upward from the side surface of the base. In other words, each of the hooks 42*d*, 42*e*, and 42*f* is substantially L-shaped in cross section. In the hooks 42*d* and 42*e*, the distance between the proximal end of the base and the proximal end of the leading end portion is substantially identical with the thickness of the holder 45. The hooks 42*g* only have the base and do not have the leading end portion. The base of each hook 42*g* is arranged to have a length (degree of protrusion) with which the hooking with a later-described hole 45*g* is not canceled within a predetermined temperature range. The length (degree of protrusion) of the base of each hook 42*f* is greater than those of the hooks 42*d* and 42*e*. Furthermore, the hooks 42*e* and 42*f* are identical in length along the circumference of the lip component 42 and are longer than the other hooks 42*d* and 42*g*. The hooks 42*g* have the shortest circumferential length.

The holder 45 is made of resin having higher rigidity than the lip component 42 and lower linear expansion coefficient than the lip component 42 (e.g., ABS resin, PBT/ABS resin, or the like). As shown in FIG. 8, the holder 45 has a pair of elongated portions 45*a* extending along the main scanning direction and a pair of shortened portions 45*b* provided between the ends of the elongated portions 45*a*.

Figure 9B:
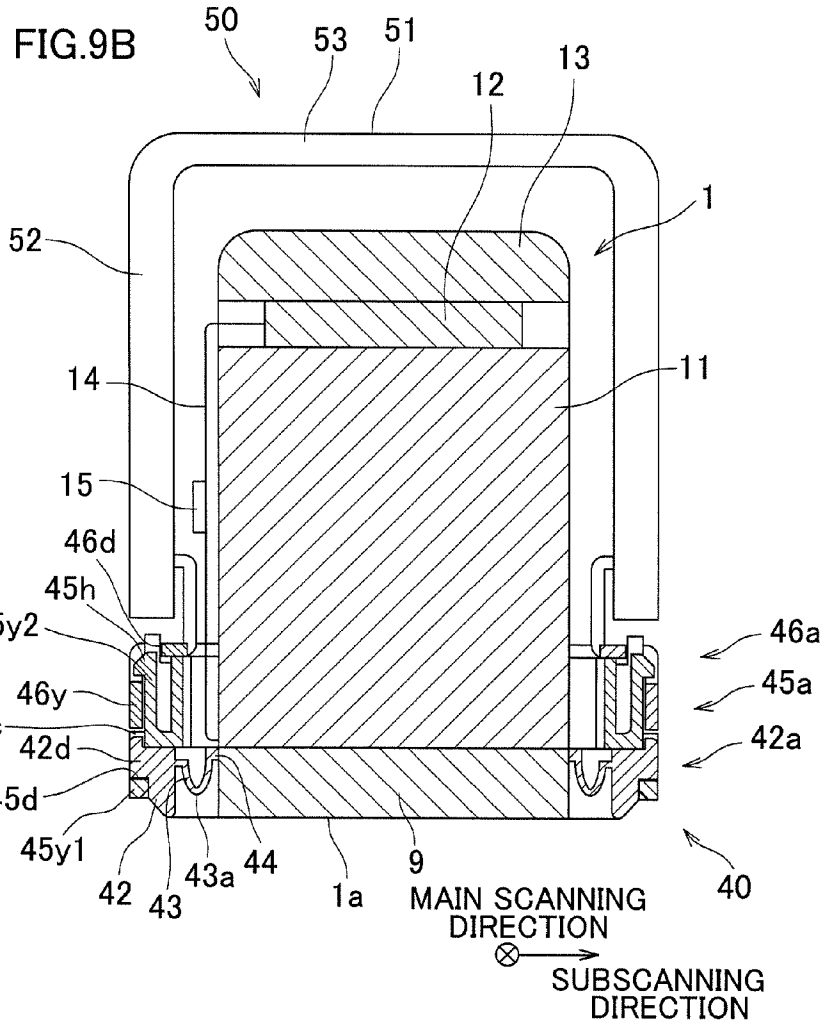
FIG. 9A and FIG. 9B are cross sections taken along the IXa-IXa line and the IXb-IXb line in FIG. 7A.
Figure 9A:
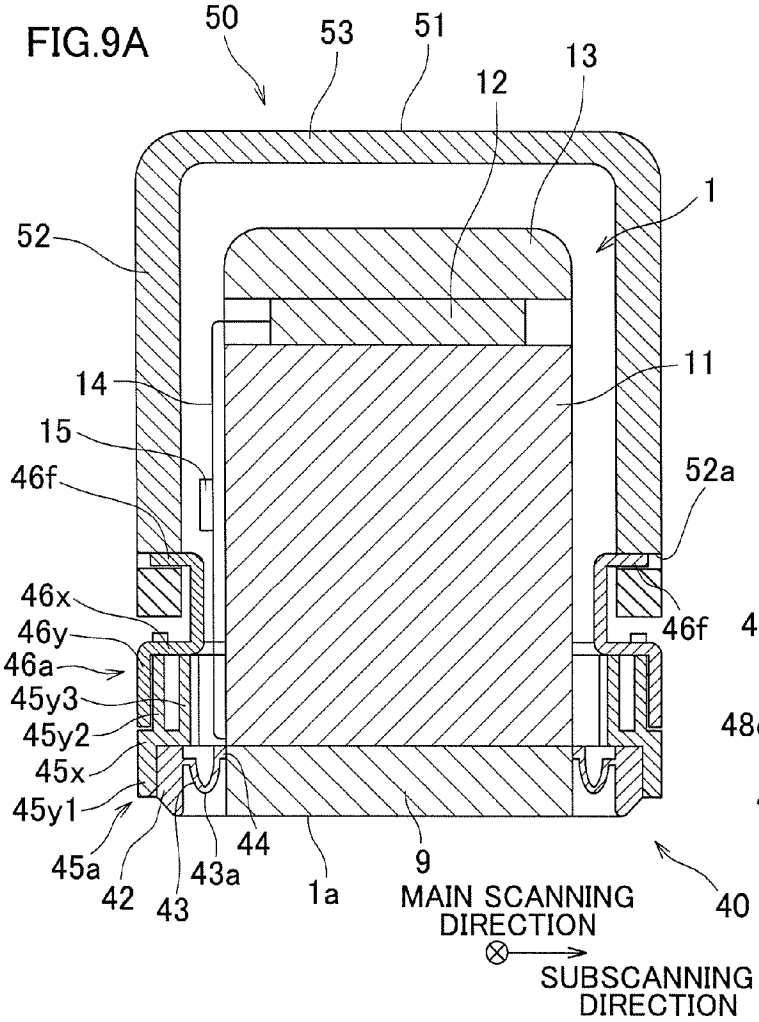

The holder 45 is an annular component surrounding the passage unit 9 over the lip component 42, and is constituted by, as shown in FIG. 9A, a horizontal portion 45*x*, a first vertical portion 45*y*1, a second vertical portion 45*y*2, and a third vertical portion 45*y*3. Through a central opening formed by the frame-shaped horizontal portion 45*x*, the head 1 is inserted. The first vertical portion 45*y*1 extends downward from the outer lateral end portion of the horizontal portion 45*x*. The second vertical portion 45*y*2 extends upward from the center of the horizontal portion 45*x*. The third vertical portion 45*y*3 extends upward from the inner lateral end portion of the horizontal portion 45*x* to be separated from the second vertical portion 45*y*2. As the lower surface of the horizontal portion 45*x* abuts to the upper end of the lip component 42, the upward deformation of the lip component 42 is restrained. Furthermore, as the inner side face of the first vertical portion 45*y*1 abuts to the outer side face of the lip component 42, the outward curving of the lip component 42 is restrained. The two vertical portions 45*y*2 and 45*y*3 are identical in height so that the rigidity of the holder 45 is improved.

Figure 7A:
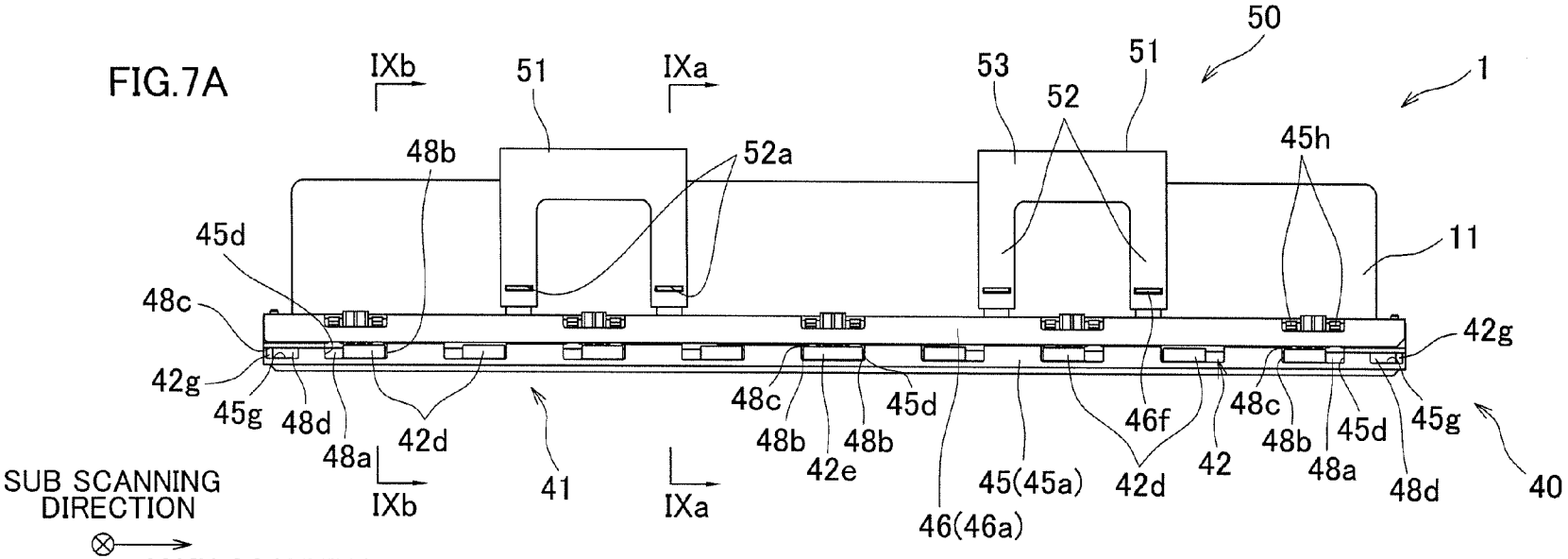
FIG. 7A and FIG. 7B are an elevation view and a profile showing parts of the head mechanism and the capping mechanism, respectively.

Through each elongated portion 45*a* of the holder 45, as shown in FIG. 9B, nine holes 45*d* each of which is defined in part by the lower surface of the horizontal portion 45*x* are formed to penetrate the first vertical portion 45*y*1. The inner circumferential surfaces (first receiving portions) defining the holes 45*d* opposes the hooks 42*d* and 42*e* of the lip component 42 in the sub-scanning direction. As shown in FIG. 7A, in the front elevation, the opening of each hole 45*d* is rectangular in shape and elongated in the main scanning direction. The upper side of the opening of each hole 45*d* is defined by the bottom surface of the horizontal portion 45*x*.

Figure 7B:
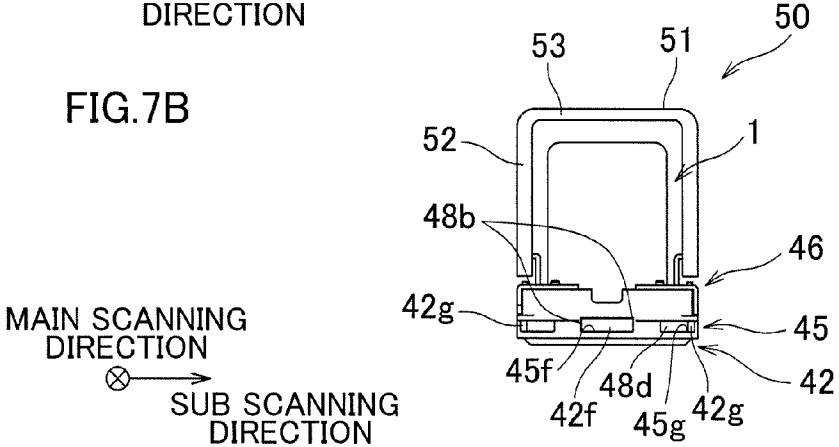

As shown in FIG. 7B and FIG. 8, each shortened portion 45*b* has holes 45*f* opposing the respective hooks 42*f*. Furthermore, at each corner portion 45*r* where the elongated portion 45*a* and the shortened portion 45*b* are connected with each other, a hole 45*g* is formed to oppose the hook 42*g*. (The inner circumferential surfaces defining the holes 45*g* are second receiving portions.) The lip component 42 is connected to the holder 45 such that, from the inside, the inner circumferential surfaces defining the holes 45*d*, 45*f*, and 45*g* are hooked on the hooks 42*d* to 42*g*. In this regard, the hooks 42*d* to 42*g* engage with the holes 45*d*, 45*f*, 45*g* in the vertical direction (which is orthogonal to the ejection surface 1*a*) and in the horizontal direction (which is orthogonal to the main scanning direction and the vertical direction). In addition to the above, the leading end portion of each of the hooks 42*d*, 42*e*, and 42*f* is higher than the inner opening of each of the holes 45*d* and 45*f*. Because the hooks 42*d*, 42*e*, and 42*f* are elastically deformable, it is easy to hook the inner circumferential surfaces defining the holes 45*d* and 45*f* on the hooks 42*d*, 42*e*, and 42*f*. Each leading end portion is arranged to be high enough to secure horizontal engagement, even when the holes 45*d* and 45*f* are enlarged due to temperature decrease.

These holes 45*d*, 45*f*, and 45*g* are sufficiently larger than the protrusions of the hooks 42*d* to 42*g* as shown in FIG. 7A and FIG. 7B. The holes 45*d*, 45*f*, and 45*g* are identical in length in the circumferential direction of the holder 45, and gaps 48*a* and 48*b* are formed on the either side of the hook 42*d* in the main scanning direction when the center of the hook 42*e* is aligned with the center of the corresponding hole 45*d* (i.e., when the lip component 42 is connected to the holder 45). At a reference temperature (e.g., 20 degrees Celsius), among the two gaps 48*a* and 48*b* on the either side of the hook 42*d*, the outer gap 48*a* which is farther from the center of the elongated portion 45*a* is larger than the inner gap 48*b* which is closer to the center of the elongated portion 45*a*.

In the vertical direction, gaps 48*c* are formed between the upper surfaces of the bases and the inner circumferential surfaces defining the holes 45*f* and 45*g* when the lower surfaces of the bases contact the inner circumferential surfaces defining the hole 45*f* and 45*g*, and gaps 48*c* are formed between the upper surfaces of the bases and the vertical portion 46*y* of the frame 46 when the lower surfaces of the bases contact the inner circumferential surfaces defining the holes 45*d*. In the present embodiment, the vertical length of each gap 48*c* is substantially identical with the horizontal length of each gap 48*b*.

As the temperature becomes lower than the reference temperature, the lip component 42 contracts as compared to the holder 45, on account of the difference in the linear expansion coefficient between the lip component 42 and the holder 45. For this reason, the hooks 42*d* approach the inner circumferential surfaces defining the holes 45*d*, with the result that the horizontal length of the gaps 48*b* decreases in the main scanning direction. In this regard, when the temperature decrease falls within an expected temperature range concerning the storage, the hooks 42*d* do not contact the inner circumferential surfaces defining the holes 45*d*, and hence the lip component 42 is not corrugated. As the temperature becomes higher than the reference temperature, the lip component 42 elongates as compared to the holder 45, with the result that the horizontal length of the gaps 48*a* increases. In this regard, when the temperature increase falls within the expected temperature range, the hooks 42*d* do not contact the inner circumferential surfaces defining the holes 45*d*, and hence the lip component 42 is not corrugated.

It is noted that, the horizontal length of the gap 48*a* is arranged to be longer than the horizontal length of the gap 48*b* in order to allow for a large margin of temperature changes in the temperature increase with respect to the reference temperature, as compared to the temperature decrease. In the present embodiment, the elongation and contraction of the lip component 42 are highly tolerated because the contact between the hooks 42*d* and the inner circumferential surfaces defining the holes 45*d* is restrained in a sufficiently wide temperature range.

In the present embodiment, the distance between the outer circumferential surfaces of the shortened portions 42*b* is slightly shorter than the distance between the inner circumferential surfaces of the shortened portions 45*b*. For this reason, a small gap is formed between the shortened portion 42*b* and the shortened portion 45*b* when the lip component 42 is attached to the holder 45. This gap allows for the elongation of the lip component 42 in the longitudinal direction in order to prevent the corrugation at the time of temperature increase.

In addition, the base of the hook 42*f* has a higher degree of protrusion than the bases of the hooks 42*d* and 42*e*. This allows the lip component 42 to smoothly contract or elongate at the time of temperature changes. Furthermore, the radius of curvature of the inner circumferential surface at each corner portion 45*r* of the holder 45 is smaller than the radius of curvature of the outer circumferential surface at each corner portion 42*r* of the lip component 42. When the lip component 42 is attached to the holder 45, the corner portions 42*r* and 45*r* of these components are distanced from each other. As the ambient temperature increases, the corner portions 42*r* of the lip component 42 deform to fit the corner portions 45*r* of the holder 45 to allow each of the elongated portion 42*a* and the shortened portion 42*b* to elongate in the longitudinal direction. Furthermore, as described above, because the hooks 42*g* at the corner portions 42*r* of the lip component 42 only have bases, this hook 42*g* does not obstruct the widening or narrowing of the gap between the corner portions 42*r* and 45*r*, even if the temperature changes in a wide range.

Each elongated portion 45*a* of the holder 45 has, as shown in FIG. 7A and FIG. 8, a plurality of hooks (second hooks) 45*h*. The hooks 45*h* are provided along the main scanning direction at intervals. The hooks 45*h* are grouped into pairs in each of which the two hooks are close to each other. Each hook 45*h* has, as shown in FIG. 9B, a cantilevered piece extending upward from the central part of the horizontal portion 45*x* and a leading end portion extending outward from the top of the cantilevered piece. The hook 45*h* is slightly higher than the second and third vertical portions 45*y*2 and 45*y*3.

The frame 46 is more rigid than the holder 45 and is made of metal (such as stainless steel) having a lower linear expansion coefficient than the holder 45. As shown in FIG. 8, the frame 46 is composed of two linear components 46*a* that are different components extending along the main scanning direction in a parallel manner. Furthermore, the linear components of the frame 46 sandwich the passage unit 9 in the sub-scanning direction, on the outside of the elongated portions 45*a* of the holder 45. In other words, the elongated portions 45*a* of the holder 45 are sandwiched between the linear components 46*a* of the frame 46 and the passage unit 9 as shown in FIG. 9A and FIG. 9B.

Each linear component 46*a* includes, as shown in FIG. 8 and FIG. 9A, a horizontal portion 46*x*, a vertical portion 46*y*, and a plurality of hooks (third hooks) 46*f*. The flat horizontal portion 46*x* is provided on the second vertical portion 45*y*2 and the third vertical portion 45*y*3 of the holder 45. The vertical portion 46*y* extends downward from the outer lateral end of the horizontal portion 46*x*. The hooks 46*f* are provided along the main scanning direction at intervals. The hooks 46*f* extend upward from the inner lateral end of the horizontal portion 46*x*. At around of the tip of the hook 46*f*, a leading end portion is formed to horizontally extend outward. As shown in FIG. 8, the horizontal portion 46*x* and the vertical portion 46*y* extend in the main scanning direction.

At the corner portion where the horizontal portion 46*x* is connected to the vertical portion 46*y*, as shown in FIG. 8, a plurality of holes 46*d* are formed. These holes 46*d* are aligned along the main scanning direction. As shown in FIG. 7A, each hole 46*d* opposes a pair of hooks 45*h* and has a length of covering both of these two hooks 45*h*. As the leading end portions of the hooks 45*h* hook the inner circumferential surfaces (second receiving portions) that define the holes 46*d* from the inside, the holder 45 is connected to the frame 46. In so doing, the hooks 45*h* are vertically engaged with the inner circumferential surfaces defining the holes 46*d*. Each hook 45*h* is higher than the two vertical portions 45*y*2 and 45*y*3. For this reason, when the frame 46 is attached to the holder 45, the top of the hook 45*h* horizontally overlaps the horizontal portion 46*x*. The hooks 45*h* are engaged with the inner circumferential surfaces defining the holes 46*d*, in horizontal direction, too. When hooked, a gap is formed to entirely surround the hook 45*h* for each hole 46*d*. This gap allows the holder 45 to three-dimensionally deform with respect to the frame 46, in response to temperature changes within the expected temperature range.

Referring back to FIG. 2, the cap elevation mechanism 50 includes two lifting components 51 and an elevator (not illustrated) that moves up or down the lifting components 51 with respect to the head 1. The elevator of the present embodiment includes a solenoid and is controlled by the control unit 100. The elevator may be arranged in a different manner on condition that the lifting components 51 are moved up or down by the same.

The two lifting components 51 are provided along the main scanning direction and are symmetrical about the center of the holder 45. The lifting component 51 is formed by casting and made of resin in the same manner as the holder 45, and is constituted by four arms 52 and a base 53. The base 53 is, as shown in FIG. 8, a flat plate member that is rectangular in plan view, and the arms 52 extend vertically downward from the respective corners of the base 53. The four arms 52 are grouped into two pairs in the main scanning direction, and the pairs sandwich the head 1 in the sub-scanning direction. As shown in FIG. 9A and FIG. 9B, the lifting component 51 is U-shaped when viewed in the main scanning direction.

At the leading end portion of the arm 52 is formed a hole 52*a*. The hole 52*a* penetrates, as shown in FIG. 9A, the arm 52 in the sub-scanning direction to oppose the leading end portion of the hook 46*f*. The hole 52*a* is formed to be sufficiently larger than the cross section of the leading end. The frame 46 is connected to the lifting component 51 such that the leading end portions are hooked from the inside on the inner circumferential surfaces (third receiving portions) defining the holes 52*a*. In so doing, the hooks 46*f* are vertically engaged with the holes 52*a*. There are gaps between the leading end portions of the hooks 46*f* and the inner circumferential surfaces defining the holes 52*a*.

In addition, paired arms sandwiching the head 1 are arranged so that their leading ends are slightly inside their proximal ends. In other words, the arms 52 are inclined inward. With this, the hook 46*f* is biased by the arm 52 toward the head 1. On account of this structure, the arm 52 does not come out of the hooks 46*f* even if the base 53 is elongated in the sub-scanning direction due to temperature increase. In this regard, as shown in FIG. 8, the both end portions of the linear component 46*a* in the main scanning direction protrude inward along the sub-scanning direction. These protruding portions are provided on the vertical portions 45*y*2 and 45*y*3 of the shortened portions 45*b* of the holder 45 in order to receive the biasing forces from the arms 52. With this, the linear components 46*a* do not fall down even when the base 53 contracts in the sub-scanning direction due to temperature decrease and the biasing forces from the arms 52 are increased.

With the structure above, as the elevator is driven under the control of the control unit 100, the two lifting components 51 are moved up or down. As the lifting components 51 are moved up or down, the cap 41 including the lip component 42 is moved up or down. After the movement, the cap 41 selectively takes either an abutting position (shown in FIG. 3) or a separated position (shown in FIG. 1, FIG. 9A, and FIG. 9B). At the abutting position, as shown in FIG. 3, the ejection space S1 is in the sealed state of being separated from the external space S2, as the ejection space S1 is sandwiched between the ejection surface 1*a* and the upper surface 5*a* of the platen 5. Furthermore, at the separated position, the ejection space S1 is in a non-sealed state in which the ejection space S1 is open to the external space S2.

At the abutting position, a part of the inner circumferential surface of the arm 52 defining the hole 52*a*, which part is an upper part in the vertical direction, abuts to the leading end of the hook 46*f*. Furthermore, the horizontal portions 46*x* of the frame 46 abut to the upper ends of the two vertical portions 45*y*2 and 45*y*3 of the holder 45, and the lower surface of the horizontal portion 45*x* of the holder 45 abuts to the upper end of the lip component 42. In the present embodiment, these three abutting positions are provided along the vertical direction. With this, the pressure from the elevator onto the arm 52 linearly reaches the platen 5 via the frame 46, the holder 45, and the lip component 42, resulting in a good sealed state.

When a temperature change occurs in the sealed state, horizontal relative changes at least among the components are not restricted at the three abutting portions. For this reason, no distortion causing improper sealing occurs at each abutting portion. In the non-sealed state, distortion does not occur at all because the degree of freedom in the relative changes among the components is high. As such, the present embodiment makes it possible to achieve a sufficient sealed state at each abutting position in a wide temperature range.

Now, how the capping operation is controlled by the control unit 100 will be described.

To begin with, the control unit 100 determines whether a capping instruction has been received. Before receiving the capping instruction, the lip component 42 is at the separated position. Receiving the capping instruction, the control unit 100 drives the elevator of the cap elevation mechanism 50 of the capping mechanism 40 to cause the leading end of the lip component 42 to abut to the upper surface 5*a* of the platen 5 by applying a predetermined pressure. As a result, the ejection space S1 is in the sealed state in which the space is separated from the external space S2.

When the ambient temperature (environmental temperature) of the head 1 is higher than a predetermined temperature, the lip component 42 swells in accordance with temperature increase. The elongated portions 42*a* extend in both forward and reverse main scanning directions from the hooks 42*e*, whereas the shortened portions 42*b* extend in both forward and reverse main scanning directions from the hooks 42*f*. As the elongated portions 42*a* and the shortened portions 42*b* extend, the stresses are centered at the corner portions 42*r* of the lip component 42. For this reason, each corner portion 42*r* of the lip component 42 deforms toward the corresponding corner portion 45*r* of the holder 45, and the radius of curvature thereof is decreased. The deformation of the corner portions 42*r* cancels out the elongation above.

In addition to the above, when the ambient temperature is lower than the predetermined temperature, the lip component 42 contracts in accordance with temperature decrease. In this case, the elongated portions 42*a* contract toward the centers of the hooks 42*e* in the main scanning direction. The contraction of the lip component 42 is absorbed by the gaps 48*b*. When the ambient temperature is decreased, the lip component 42 substantially uniformly contracts while the hooks 42*d* are restricted by the inner circumferential surfaces defining the holes 45*d*. Because of the above, the lip component 42 is hardly corrugated and hence the sealed state is maintained.

The capping operation finishes in this way. Thereafter, when receiving a signal such as a recording instruction from an external apparatus, the control unit 100 drives the elevator of the capping mechanism 40 to remove the leading end of the lip component 42 from the platen 5. As a result, the ejection space S1 is in the non-sealed state in which the space is open to the external space S2. Then the recording operation is carried out under the control of the control unit 100 as described above.

As described above, the printer 101 of the present embodiment is advantageous in that, because gaps 48*a* and 48*b* are formed between the inner circumferential surfaces of the holder 45 defining the holes 45*d* and the hooks 42*d* of the lip component 42, the lip component 42 is not easily deformed even if the environmental temperature changes. For this reason, the air tightness is maintained in the ejection space S1 in the sealed state when the capping is carried out, and ink around the ejection opening 108 is not easily dried.

In addition to the above, the gap 48*a* is larger than the gap 48*c*. This makes it possible to effectively absorb the elongation of the elongated portion 42*a*. As a variation, the gap 48*b* on the inner side of the hook 42*d* may be larger than the gap 48*c*. It is possible in this case to effectively absorb the contraction of the elongated portion 42*a*. Both of the gaps 48*a* and 48*b* are preferably larger than the gap 48*c*.

In addition to the above, because the gaps 48*c* are vertically formed between the hooks 42*d* and the frame 46 which is in the peripheral to the lip component 42 having the hooks 42*d*, a slight inclination of the platen 5 is absorbed by this gap 48*c*. The lip component 42 therefore closely contacts the platen 5. Furthermore, because the vertical elongation of the lip component 42 is absorbed by the gaps 48*c*, the deformation of the lip component 42 is further restrained. Furthermore, when the holder 45, the frame 46, and the lifting components 51 are assembled, there are gaps between the leading end portions of the hooks 45*h* and 46*f* and the inner circumferential surfaces defining the holes 46*d* and 52*a*. These gaps absorb the swell of the holder 45, the frame 46, the arm 52 or the like. The deformation of the cap 41 is therefore prevented both inward and outward.

In addition to the above, because the gaps 48*a* and 48*b* are formed on either side of the hook 42*d*, the elongation of the elongated portion 42*a* in the main scanning direction is absorbed by the gaps 48*a* and 48*b*. This further restrains the deformation of the lip component.

In addition to the above, the holder 45 and the head 1 sandwich the elongated portions 42*a* of the lip component 42. As such, the lip component 42 is provided inside the holder 45. With this, even if the lip component 42 is curved outward on account of swelling or an outward pressure of the diaphragm 43, the hooks 42*d* and 42*e* do not easily come out of the holes 45*d*.

Because the hooks 42*d* to 42*g* are formed on the lip component 42 and the holes 45*d*, 45*f*, and 45*g* are formed through the holder 45, the rigidity of the lip component 42 is maintained.

The hooks 45*h* are formed on the holder 45, the holes 46*d* are formed through the frame 46 (linear components 46*a*), and the holder 45 is connected to the frame 46 by the hooks 45*h* and the holes 46*d*. According to this structure, there are gaps between the leading end portions of the hooks 45*h* and the inner circumferential surfaces defining the holes 46*d*, with the result that the elongation of the holder 45 is absorbed by the gaps. This restrains the deformation of the holder 45 with respect to the frame 46. As a result, the lip component 42 closely contacts the platen 5 with certainty. Furthermore, the rigidity of the holder 45 is maintained.

In addition to the above, the linear components 46*a* and the head 1 sandwich the elongated portions 45*a* of the holder 45. As such, the holder 45 is provided inside the linear components 46*a*. According to this arrangement, the holder 45 is curved outward together with the lip component 42 on account of swelling or an outward pressure of the diaphragm 43, and hence the hooks 45*h* do not easily come out of the holes 46*d*.

The hooks 46*f* are formed on the linear components 46*a*, the holes 52*a* are formed through the arms 52, and the frame 46 is connected to the arms 52 by these hooks 46*f* and holes 52*a*. Therefore, there are gaps between the leading end portions of the hooks 46*f* and the inner circumferential surfaces defining the holes 52*a*, with the result that the elongation of the arm 52 is absorbed by the gaps. It is therefore possible to restrain the linear components 46*a* of the frame 46 from being vertically tilted.

The lifting component 51 is U-shaped when viewed in the main scanning direction. In case where such a lifting component 51 is formed by injection molding, the arms 52 tend to be slightly tilted such that the leading end of each arm is positioned inside in the sub-scanning direction. On account of this lifting component 51, the hooks 46*f* are biased inward by the arms 52. According to this structure, even if the base 53 elongates in the sub-scanning direction due to increase in the environmental temperature, the hooks 46*f* do not come out of the holes 52*a*.

Figure 10:
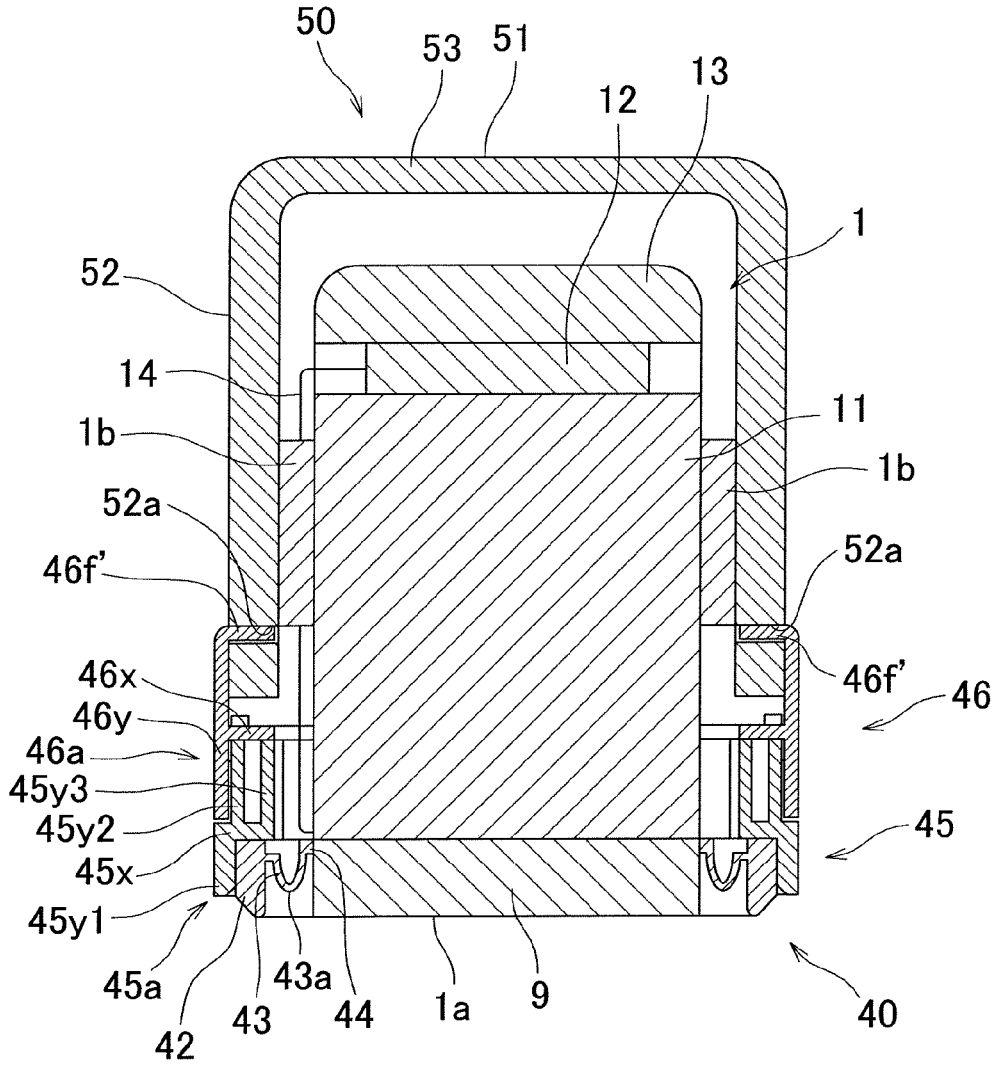
FIG. 10 relates to a variation of the liquid ejection apparatus of the embodiment of the present invention, and is a cross section of a part of the head mechanism and the capping mechanism.

A variation will be described below. As shown in FIG. 10, hooks 46*f* of the linear components 46*a* may extend upward from the outer lateral end portions of the horizontal portions 46*x*. The hooks 46*f* are each constituted by a cantilevered piece and a leading end portion in the same manner as the hooks 46*f*. In the present case, the leading end portion may extend inward from the upper end of the cantilevered piece and hooked on the hole 52*a* of the arm 52 from the outside. The linear components 46*a* of the frame 46 are connected to the arms 52 while the hooks 46*f* and the head 1 sandwich the arms 52 in the sub-scanning direction. Being different form the case where the leading end portion is hooked on the hole 52*a* from the inside, each hook 46*f* does not receive a biasing force from the arm 52. Because of this, the deformation of the holder 45 and the lip component 42 via the frame 46 is restrained. As a result, the lip component 42 closely contacts the platen 5 with certainty. Furthermore, even if the arms 52 are tilted outward on account of a difference in the linear expansion coefficient between the frame 46 and the lifting component 51, the hooks 46*f* do not easily come out of the holes 52*a*.

In addition to the above, a plurality of protrusions 1*b* may be formed on either side of the head 1 (e.g., the reservoir unit 11). Such protrusions 1*b* are formed to oppose the arms 52 in the sub-scanning direction. Furthermore, the protrusions 1*b* extend in the vertical direction and the leading end faces thereof contact the inner surfaces of the arms 52. That is to say, as the lifting components 51 are moved up or down, the arms 52 slide on the protrusions 1*b*. With this structure, the arms 52 move with a predetermined positional relationship with the head 1, and hence a pressure is always applied to the lip component 42 in a predetermined direction. Furthermore, in case where the leading end portions of the hooks 46*f* are hooked on the holes 52*a* from the inside, the biasing force exerted from the arms 52 to the hooks 46*f* is restrained, with the result that the corrugation of the lip component 42 on account of excessive biasing force is prevented. On the other hand, in case where the leading end portions of the hooks 46*f* are hooked on the holes 52*a* from the outside, the deformation of the arms 52 in the direction toward the head 1 is restrained, with result that the hooks 46*f* does not easily come out of the holes 52*a*.

According to a variation of the embodiment above, inner circumferential surfaces to define holes may be formed through the lip component 42 as receiving portions, and hooks paired with these holes may be formed on the holder 45. Effects similar to those of the embodiment above are achieved with this arrangement. Furthermore, one of the gaps 48*a* and 48*b* between the hooks 42*d* and 42*e* and the holes 45*d* may not be formed. In other words, one side face of the hook 42*d* or 42*e* in the main scanning direction may closely contact the inner circumferential surface defining the hole 45*d*. Furthermore, the gap 48*b* may be wider than the gap 48*a*. This arrangement is particularly effective when holes are formed through the lip component 42 and hooks are formed on the holder 45. These two arrangements are identical with each other in terms of the magnitude correlation between the linear expansion coefficients. In both arrangements, the lip component 42 contracts relative to the holder 45. The effects identical with the above are achieved on condition that the remaining components are identical with those in the embodiment above. Furthermore, the elongated portions 42*a* of the lip component 42 and the head 1 may sandwich the holder 45.

The holder 45 may be fixed to the frame 46 by screwing or by using an adhesive or the like. Furthermore, the arms 52 may be fixed to the frame 46 by screwing or by using an adhesive or the like. Furthermore, no gap may be formed between the hooks 45*h* and the holes 46*d*. No gap may be formed between the hooks 46*f* and the holes 52*a*, either.

The elongated portions 45*a* of the holder 45 and the head 1 may sandwich the linear components 46*a*. Inner circumferential surfaces as receiving portions, each inner circumferential surface defining a hole, may be formed through the holder 45, and hooks paired with the respective holes may be formed on the linear components 46*a* of the frame 46. Inner circumferential surfaces as receiving portions, each inner circumferential surface defining a hole, may be formed through the linear components 46*a*, and hooks paired with the respective holes may be formed on the arms 52. The receiving portions may be inner circumferential surfaces defining concaves, instead of the inner circumferential surfaces defining the holes. Both in the lip component and the holder, no hooks and/or holes are formed at the shortened portions.

The present invention is applicable not only to printers but also to facsimile machines, photocopiers, or the like. Furthermore, the present invention is applicable to liquid ejection apparatuses that perform recording by ejecting liquid which is not ink. The recording medium is not limited to the sheet P. Various types of recordable media may be used as the recording medium. Furthermore, the present invention is applicable irrespective of the ink ejection method. For example, while in the present embodiment the piezoelectric elements are used, the ink ejection method may be a resistance heating method or a capacitive sensing method.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a conveyance mechanism configured to convey a recording medium;

a liquid ejection head that has an ejection surface having a plurality of ejection openings and is longer in a first direction than in a second direction, the first direction being defined as a direction parallel to the ejection surface and orthogonal to a conveyance direction when the recording medium passes through a position opposing the liquid ejection head, the second direction being defined as a direction parallel to the ejection surface and orthogonal to the first direction; and a capping unit including:

(a) a cap having an annular lip component and a diaphragm, the annular lip component being made of an elastic material and surrounding the liquid ejection head, the diaphragm being made of an elastic material and being formed between the lip component and the liquid ejection head, (b) an opposing member opposing the ejection surface over an ejection space that opposes the ejection surface, and (c) a cap moving mechanism arranged to move the cap between an abutting position where the lip component abuts to the opposing member and a separated position where the lip component is separated from the opposing member, the cap further having a holder which surrounds the liquid ejection head, has a smaller linear expansion coefficient than the lip component, and has higher rigidity than the lip component, a plurality of first hooks being formed along the first direction at one of: (i) elongated portions of the lip component extending in the first direction, and (ii) parts of the holder opposing the elongated portions of the lip component, a plurality of first receiving portions hooked on the first hooks being formed along the first direction at the other of: (i) the elongated portions of the lip component, and (ii) the parts of the holder, the lip component and the holder being connected with each other such that the first hooks hook the first receiving portions in a third direction orthogonal to the ejection surface, and a plurality of first gaps being formed between the first hooks and the first receiving portions in the first direction.

2. The liquid ejection apparatus according to claim 1, wherein, the cap further has a component above the first hooks in the third direction, each of the plurality of first gaps are larger than each of a plurality of second gaps formed between the first hooks and the component.

3. The liquid ejection apparatus according to claim 1, wherein, in the first direction, the first gaps are formed on both sides of each of the first hooks.

4. The liquid ejection apparatus according to claim 3, wherein, among two first gaps on the respective sides of each of the first hooks, an outer gap which is farther from a central portion of the ejection surface, is larger than an inner gap, which is closer to the central portion of the ejection surface.

5. The liquid ejection apparatus according to claim 1, wherein, in the second direction, the holder and the liquid ejection head sandwich the elongated portions of the lip component.

6. The liquid ejection apparatus according to claim 1, wherein, the lip component is constituted by a pair of the elongated portions, and a pair of shortened portions that are provided between ends of the pair of the elongated portions and are shorter than the elongated portions, a plurality of second hooks are formed at one of: (iii) corner portions of the lip component where the shortened portions are connected to the elongated portions, and (iv) parts of the holder which oppose the corner portions of the lip component, a plurality of second receiving portions hooked on the second hooks are formed at the other of: (iii) the corner portions of the lip component, and (iv) the parts of the holder, and a plurality of third gaps are formed on both sides of each of the second hooks in a circumferential direction of the lip component.

7. The liquid ejection apparatus according to claim 6, wherein, the corner portions of the lip component are separated from the holder.

8. The liquid ejection apparatus according to claim 6, wherein, an outer circumferential surface of each of the corner portions of the lip component has a larger radius of curvature than an inner circumferential surface of each of the parts of the holder which the outer circumferential surface.

9. The liquid ejection apparatus according to claim 1, wherein, the first hooks are formed on the lip component, and the first receiving portions are formed on inner circumferential surfaces of the holder, each of the inner circumferential surfaces defining a hole.

10. The liquid ejection apparatus according to claim 1, wherein, the cap further has a frame that includes a pair of linear components extending in the first direction, and has a lower linear expansion coefficient and higher rigidity than the holder, a plurality of second hooks are formed at one of: (iii) the linear components of the frame, and (iv) parts of the holder which oppose the linear components of the frame, a plurality of second receiving portions hooked on the second hooks are formed at the other of: (iii) the linear components of the frame, and (iv) the parts of the holder, and the holder and the frame are connected with each other such that the second hooks hook the second receiving portions in the third direction.

11. The liquid ejection apparatus according to claim 10, wherein, the linear components of the frame and the liquid ejection head sandwich the holder in the second direction.

12. The liquid ejection apparatus according to claim 10, wherein, the second hooks are formed on the holder, and the second receiving portions are formed on inner circumferential surfaces of the linear components of the frame, each of the inner circumferential surfaces defining a hole.

13. The liquid ejection apparatus according to claim 10, wherein, the cap moving mechanism includes a lifting component that is made of resin having a linear expansion coefficient higher than that of the linear components of the frame but lower than that of the lip component, and has a plurality of arms which extend in the first direction, a plurality of third hooks are formed at one of: (v) leading ends of the respective arms, and (iv) parts of the linear components of the frame which oppose the leading ends of the arms, a plurality of third receiving portions hooked on the third hooks are formed at the other of: (iii) the leading ends of the respective arms, and (iv) the parts of the linear components, and the arms and the frame are connected with one another such that the third hooks hook the third receiving portions in the third direction.

14. The liquid ejection apparatus according to claim 13, wherein, the arms sandwich the liquid ejection head in the second direction, and the lifting component has a base connected to proximal ends of the respective arms.

15. The liquid ejection apparatus according to claim 13, wherein, the third hooks are formed on the linear components of the frame, the third hooks and the liquid ejection head sandwich the arms in the second direction, and the third receiving portions are formed on inner circumferential surfaces of the arms, each of the inner circumferential surfaces defining a hole.

16. The liquid ejection apparatus according to claim 15, wherein, on either side surfaces of the liquid ejection head or surfaces of the arms opposing the side surfaces, protrusions are formed which protrude toward the opposing surfaces, and leading ends of the protrusions extend along the first direction and are configured to slide on the opposing surfaces.

17. The liquid ejection apparatus according to claim 13, wherein, the third hooks are formed on the linear components of the frame, the arms and the liquid ejection head sandwich the third hooks in the second direction, and the arms bias the third hooks toward the liquid ejection head, and the third receiving portions are formed on inner circumferential surfaces of the arms, each of the inner circumferential surfaces defining a hole.

* * * * *